US009988744B2

(12) United States Patent
Mössinger et al.

(10) Patent No.: US 9,988,744 B2
(45) Date of Patent: Jun. 5, 2018

(54) HIGH-TENACITY VISCOSE MULTIFILAMENT YARN WITH LOW YARN LINEAR DENSITY

(71) Applicant: CORDENKA GMBH & CO. KG, Obernburg (DE)

(72) Inventors: Dennis Mössinger, Darmstadt (DE); Holger Scheytt, Erlenbach (DE); Kurt Uihlein, Großheubach (DE); David Wunderlich, Niedernberg (DE); Britta Zimmerer, Amorbach (DE)

(73) Assignee: CORDENKA GMBH & CO. KG, Obernburg (DE)

( * ) Notice: Subject to any disclaimer, the term of this patent is extended or adjusted under 35 U.S.C. 154(b) by 97 days.

(21) Appl. No.: 14/762,073

(22) PCT Filed: Jan. 24, 2014

(86) PCT No.: PCT/EP2014/051374
§ 371 (c)(1),
(2) Date: Jul. 20, 2015

(87) PCT Pub. No.: WO2014/118083
PCT Pub. Date: Aug. 7, 2014

(65) Prior Publication Data

US 2015/0322595 A1 Nov. 12, 2015

(30) Foreign Application Priority Data

Jan. 29, 2013 (EP) ..... 13152962

(51) Int. Cl.
*D02G 3/02* (2006.01)
*D01F 2/06* (2006.01)

(52) U.S. Cl.
CPC ..... *D02G 3/02* (2013.01); *D01F 2/06* (2013.01); *D10B 2201/24* (2013.01); *Y10T 428/2913* (2015.01)

(58) Field of Classification Search
CPC .... D02G 3/02; D01F 2/00; D01F 2/06; D01B 2201/00; D01B 2201/20; D01B 2201/24
USPC ..... 428/364; 57/243
See application file for complete search history.

(56) References Cited

U.S. PATENT DOCUMENTS

| | | | | |
|---|---|---|---|---|
| 2,607,955 A * | 8/1952 | Herrbach | ..... | D01F 2/06 264/181 |
| 6,261,689 B1 * | 7/2001 | Meraldi | ..... | D01F 2/00 428/364 |
| 2010/0174060 A1 * | 7/2010 | Kwon | ..... | D01D 5/06 536/57 |

OTHER PUBLICATIONS

Aug. 13, 2015 PCT International Preliminary Report on Patentability and Written Opinion of the International Searching Authority issued in International Application No. PCT/EP2014/051374.

* cited by examiner

*Primary Examiner* — Matthew D Matzek
(74) *Attorney, Agent, or Firm* — Oliff PLC

(57) ABSTRACT

A viscose multifilament yarn has a crystallinity in the range from 15% to 40%, and, after conditioning in the standard climate according to DIN EN ISO 139:2005, a yarn linear density in the range from ≥150 dtex to <1100 dtex and a tensile strength in the range from ≥45 cN/tex to ≤55 cN/tex.

8 Claims, No Drawings

HIGH-TENACITY VISCOSE MULTIFILAMENT YARN WITH LOW YARN LINEAR DENSITY

Cellulose is the most frequently encountered and most important naturally occurring polymer. In addition to cellulosic shaped bodies, like paper, blown films, cellophane, and sponge cloths, cellulosic fibers are considered among the most important industrial products and are used primarily for clothing purposes, as insulating materials, and as industrial reinforcement elements.

Cellulosic fibers, filaments and multifilaments can be obtained in a wide variety of ways and in different forms, which are also known to persons skilled in the art. The most common processes are the so-called regeneration processes, in which cellulose is first converted chemically into soluble unstable or easily saponifiable derivatives and dissolved. For example, cellulose acetate, cellulose formate, or cellulose carbamate are known as soluble derivatives from which cellulose can be regenerated. In the most important method, the viscose method, the unstable derivative is a cellulose xanthogenate, and the yarns produced using the viscose method are known as viscose or rayon yarns. In the viscose method, the solution is pumped through spinnerets and regenerated to form viscose filaments in a coagulation bath, washed and sized (functionally coated if necessary) in one or more post-treatment steps, and subsequently wound up on endless bobbins or processed into cut fibers.

The present invention relates to high-tenacity fibers made of a viscose multifilament yarn with a low overall linear density. Viscose multifilament yarns for industrial applications, often also designated as industrial viscose or rayon, are known and are commonly employed as reinforcement elements in industrial products, e.g. to reinforce elastomer parts and products in the form of tire cords, as hose casings, or as reinforcement elements in straps and conveyor belts. More recently, however, cellulosic fibers in the form of chopped fibers are also being used increasingly in thermoplastic reinforcement, e.g. in PP rayon composite materials, in the form of uni- and bidirectional woven fabrics, and also for reinforcing duromers such as epoxy resins.

High-tenacity cellulosic multifilament yarns with low yarn linear density are known. For example, ultra-high-tenacity yarns with a low overall linear density and made of cellulose formate and using a viscose method modified by formaldehyde are known. For example, cellulose formate fibers are described in patent publication U.S. Pat. No. 6,261,689 which were conditioned at a temperature of (20±2°) C. and a relative humidity of (65±2)%, defined as the standard climate according to EN ISO 20139 (currently: DIN EN ISO 139), and have an overall linear density of 460 dtex and a tenacity of 76 cN/tex.

Patent publication U.S. Pat. No. 3,388,117 describes a viscose method modified using formaldehyde, whereby a viscose multifilament yarn is produced that consists of 500 individual filaments and has an overall linear density of 485 dtex. After conditioning in a climate of 20° C. and 65% relative humidity, a tenacity of 78 cN/tex is measured, wherein the given tenacity is not determined for the multifilament yarn but instead on an unspecified number of individual filaments extracted from the multifilament. As it is known that the tenacity measured on a multifilament yarn is significantly lower than that measured on a certain number of individual filaments extracted from the multifilament yarn, the tenacity of the multifilament yarn described in U.S. Pat. No. 3,388,117 is significantly lower than 78 cN/tex. This is due to the lower conventional clamping lengths of 20 mm to 50 mm instead of 250 to 500 mm for multifilament yarns. In addition, it is known that the use of formaldehyde in the coagulation bath extraordinarily increases the tenacity of the viscose fibers so that the method, described in U.S. Pat. No. 3,388,117 without formaldehyde leads to a tenacity that is considerably lower than 78 cN/tex. The effect on the increase in tenacity by using formaldehyde is described by the authors A. Kh. Khakimova, N. B. Sokolova, and N. S. Nikolaeva in "Fiber Chemistry", ISSN 157-8493, ZDB-ID 2037141X, Volume 1, (6.1971), pages 631-33, among others. In addition, the cited authors describe that the use of formaldehyde leads to insoluble formaldehyde reaction products with viscose decomposition products. The insoluble reaction products lead to problems in the spinning bath circuit. In addition, there are disadvantages regarding the health of the production workers caused by the use of formaldehyde.

While patent publication GB 685,631 describes rayon yarns, i.e. viscose multifilament yarns made of 100 individual filaments with a low overall linear density of 100 den (110 dtex), they have a conditioned tenacity of only 2.3 g/den (20.4 cN/tex) and a tenacity in the oven-dried state of 2.9 g/den (25.6 cN/tex). In a further example, GB 685,631 discloses yarns with a yarn linear density of 400 den (440 dtex) having 260 filaments and moderate tenacities of 4.1 g/den (36.2 cN/tex) in the conditioned viscose multifilament yarn and 5.3 g/den (46.8 cN/tex) in the oven-dried viscose multifilament yarn.

Therefore it is the object of the present invention to provide a viscose multifilament yarn which is produced without formaldehyde and still has a high tenacity measured on the conditioned multifilament yarn.

This object is achieved by a viscose multifilament yarn which has a crystallinity in the range from 15% to 40%, and, after conditioning in the standard climate according to DIN EN ISO 139:2005, a yarn linear density in the range from ≥150 dtex to <1100 dtex and a tensile strength in the range from ≥45 cN/tex to ≤55 cN/tex.

The inventive viscose multifilament yarn is produced without using formaldehyde and still shows a tensile strength measured on the viscose multifilament yarn in the range from ≥45 cN/tex to ≤55 cN/tex.

How surprising the inventive viscose multifilament yarn is for a person skilled in the art is demonstrated by the fact that even the inventors have no explanation as to why the inventive viscose multifilament yarn, having the combination of characteristics of a yarn linear density in the range from ≥150 dtex to <1100 dtex and a crystallinity in the range from 15% to 40%, has a tensile strength measured on the viscose multifilament yarn in the range from ≥45 cN/tex to ≤55 cN/tex. In comparison, reference is made to the fact that the crystallinity of the viscose multifilament yarn from U.S. Pat. No. 3,388,117, produced with formaldehyde, is 45% and thus considerably higher.

Within the context of the present invention, the term "conditioned" means that the inventive viscose multifilament yarn is stored in the previously mentioned standard climate until the yarn has reached its equilibrium moisture of 13±1 wt. %, corresponding to the standard climate, and therefore no longer changes in weight. For this purpose, a conditioning time in the previously mentioned standard climate of ≥16 h is required.

In the previously mentioned conditioned state, the textile data for the inventive viscose multifilament yarn, e.g. yarn linear density, breaking force, tensile strength, and elongation at break, are measured under the following conditions according to DIN EN ISO 2062:2009:

CRE tensile strength testing machine with pneumatic clamps [CRE—constant rate of specimen extension], Testing of multifilament yarns with a protective twist of 100 t/m (t/m=turns/meter), Clamping length of the test specimens: 500 mm, Traction speed (traverse speed): 500 mm/min (100%/min).

The conditioning and test conditions mentioned in the previously cited standards are comparable to the relevant standard for the synthetic fiber industry (BISFA "Testing methods for viscose, cupro, acetate, triacetate and lyocell filament yarns", 2007 edition) and the corresponding international standards (DIN EN ISO 6062, DIN EN 139, ASTM D885, ASTM D1776).

The crystallinity of the inventive viscose multifilament yarn is determined by wide angle X-ray scattering (WAXS) as described in Hermans, P. H., Weidinger, A., Textile Research Journal 31 (1961) 558-571, wherein the values determined have an estimated maximum error of ±1.5 percentage points.

In a preferred embodiment, the inventive viscose multifilament yarn has a crystallinity in the range from 20% to 35%, a yarn linear density in the range from ≥170 dtex to <900 dtex, and a tensile strength in the range from ≥45 cN/tex to ≤55 cN/tex.

In a particularly preferred embodiment, the inventive viscose multifilament yarn has a crystallinity in the range from 24% to 30%, a yarn linear density in the range from ≥200 dtex to <840 dtex, and a tensile strength in the range from ≥48 cN/tex to ≤53 cN/tex.

In a preferred embodiment, the inventive viscose multifilament yarn has a crystallite width in the range from 2.5 nm to 5.0 nm, particularly preferably in the range from 3.0 nm to 4.5 nm, and a crystallite height in the range from 9.0 nm to 13.0 nm, particularly preferably in the range from 10 nm to 12 nm. The crystallite width is thereby determined from the reflection of the L(1-10) crystal face, and the crystallite height from the reflection of the L(004) crystal face. High-tenacity cellulosic fibers which are spun from viscoses/coagulation baths modified with formaldehyde and can be drawn correspondingly further show significantly larger L(004) reflections. Cordenka EHM® (no longer produced) exhibited for example a crystallite height of 15.0 nm. [M. G. Northolt, H. Berstoel, H. Maatman, R. Huisman, J. Veurink, H. Elzterman, *Polymer* 2001, 42, 8249-8264.]

In a preferred embodiment, the inventive viscose multifilament yarn has a double refraction $\Delta n \cdot 10^4$ in the range from 300 to 450, particularly preferably in the range from 330 to 420. The double refraction $\Delta n$ is measured with the aid of an interference microscope [J. Lenz, J. Schurz, D. Eichinger, Lenzinger Berichte 1994, 9, p. 21; P. H. Hermans, Contribution to the Physics of Cellulose Fibres, Chapter 7, Elsevier, Amsterdam, N.Y., 1946]. It is noted in comparison that the double refraction $\Delta n \cdot 10^4$ of the viscose multifilament yarn produced using formaldehyde from U.S. Pat. No. 3,388,117 lies in the range from >530 to 576, and is thus significantly higher.

In a further preferred embodiment, the inventive viscose multifilament yarn has a filament linear density in the range from 1.2 to 4.0 dtex.

In a further preferred embodiment, the inventive viscose multifilament yarn has a filament linear density in the range from 2.4 to 3.0 dtex.

In a further preferred embodiment, the inventive viscose multifilament yarn has an elongation at break in the range from ≥5% to ≤20%.

In a further preferred embodiment, the inventive viscose multifilament yarn has an elongation at break in the range from ≥6% to ≤15%.

The inventive viscose multifilament yarn is surprisingly obtained by the method described in Example 2 of GB 685,631, which is modified with respect to multiple technical characteristics, which are described in the following. At no point in the inventive method is formaldehyde used.

Instead of cotton linters, pulp from coniferous or deciduous wood (softwood or hardwood) is used.

Prior to the spinning process, viscose modifiers (e.g. amine ethoxylates like ethoxylated oleic acid amines or polyethylene glycols like PEG 1500) are added at a concentration in the range from 0.01 to 1.0 wt. % relative to the viscose.

Spinnerets with a hole diameter <100 μm are used, preferably with a hole diameter in the range from 40 to 80 μm.

The spinning speed at the first take-up reel is less than 50 m/min and lies preferably in the range from 10 to 40 m/min.

Transport of the thread from the spinneret into the coagulation bath is carried out by a spinning tube, wherein the transport of the thread in the spinning tube is supported by a flow of the coagulation bath in the direction of the fiber withdrawal.

The sulfuric acid concentration in the coagulation bath is greater than 15 g/liter and preferably lies in the range from 20 to 120 g/liter.

Sodium sulfate and zinc sulfate are added to the coagulation bath, preferably in a concentration from 25 to 250 $g/liter_{coagulation\ bath}$.

The temperature of the coagulation bath is higher than 30° C. but lower than 100° C. and lies preferably in the range from 40 to 95° C.

The downstream fixing bath contains sulfuric acid, preferably in a concentration in the range from 20 to 120 $g/liter_{fixing\ bath}$ and also serves as the decomposition bath for cellulose xanthogenate.

The spun yarn is drawn by more than 175%, and drawing preferably lies in a range from 180 to 220%.

The inventive viscose filament yarn is preferably produced in a two-stage process, wherein the yarn is spun and wound up in the first stage, and the coiled yarn is unwound and washed in the second stage.

The following table provides an exemplary overview of inventive viscose multifilament yarns with a conditioned yarn linear density of 204 dtex to 1013 dtex. The inventive viscose multifilament yarns were obtained by the previously cited modifications to the production method described in Example 2 of GB 685 631 and conditioned in the standard climate according to DIN EN ISO 139:2005, i.e. at a temperature of 20.0° C. and at a relative humidity of 65%, and the textile data yarn linear density, maximum tensile force, tensile strength, and elongation at break were measured in the conditioned state according to DIN EN ISO 2062:2009 under the previously described conditions. In DIN EN ISO 2062:2009, the tensile strength is designated as tenacity, and elongation at break as breaking elongation.

Further, the table includes, for some of the exemplary inventive viscose multifilament yarns, values for the crystallinity determined by wide angle X-ray scattering (WAXS), values for the crystallite width determined from the reflection of the L(1-10) crystal face, values for the crystallite height determined from the reflection of the L(004) crystal face, and a value for the double refraction $\Delta n \cdot 10^4$ measured via interference microscopy.

| Parameter | Example 1 | 2 | 3 | 4 | 5 | 6 | 7 |
|---|---|---|---|---|---|---|---|
| Yarn linear density [dtex] | 204 | 425 | 640 | 643 | 801 | 815 | 1013 |
| Filament count | 120 | 270 | 240 | 400 | 300 | 300 | 380 |
| Maximum tensile force [N] | 9.2 | 19.9 | 32.1 | 31.3 | 41.0 | 42.3 | 51.9 |
| Tensile strength [cN/tex] | 45.0 | 46.8 | 50.2 | 48.6 | 51.2 | 52.0 | 51.4 |
| Elongation at break [%] | 6.1 | 7.7 | 9.2 | 8.5 | 9.7 | 9.2 | 10.1 |
| Crystallinity [%] | — | — | 26.5 | — | — | 26.1 | — |
| Crystallite width [nm] | — | — | 3.8 | — | — | 3.7 | — |
| Crystallite height [nm] | — | — | 11.3 | — | — | 11.0 | — |
| Double refraction [$\Delta n \cdot 10^4$] | — | — | — | — | — | 390 | — |

As already mentioned, the tensile strength of a selected number of individual filaments extracted from a multifilament yarn is greater than the tensile strength measured on the multifilament yarn. If one arbitrarily takes 20 individual filaments of the viscose multifilament yarn from Example 3, conditions and measures each of the 20 individual filaments, as was previously described for the viscose multifilament yarn, and averages the 20 individual filament values, a tensile strength of 60.4 cN/tex and an elongation at break of 11.8% are obtained. Thus, the tensile strength measured on the conditioned individual filaments is 20% greater and the elongation at break is 28% higher than the corresponding values which were measured on the viscose multifilament yarn of Example 3.

In oven-dried yarn tests, i.e. after ≥2 h of drying of the inventive viscose multifilament yarn at 105° C. and using the previously described settings of the tensile strength testing machine, significantly increased tensile strengths are measured. The following table shows the difference in textile data from the same yarn example, the measurements being obtained in conditioned (DIN EN ISO 139:2005) and oven-dried states.

| Parameters tested | Measuring conditions: Conditioning > 16 h at 20° C. and 65% relative humidity | Oven drying (2 h at 105° C.) |
|---|---|---|
| Yarn linear density [dtex] | 646 | 560 |
| Filament count | 240 | 240 |
| Maximum tensile force [N] | 32.2 | 36.0 |
| Tensile strength [cN/tex] | 49.8 | 63.0 |
| Elongation at break [%] | 8.62 | 8.16 |

As already mentioned, the inventive viscose multifilament yarn has a yarn linear density in the range from ≥150 dtex to <1100 dtex, preferably from ≥170 dtex to <900 dtex, and particularly preferably ≥200 dtex to <840 dtex.

In a further preferred embodiment, the inventive viscose multifilament yarns have a yarn linear density in the range from ≥150 dtex to <1100 dtex or a yarn linear density in the range from ≥170 dtex to <900 dtex or a yarn linear density in the range from ≥200 dtex to <840 dtex and contain filaments with a filament linear density between 1.2 and 4.0 dtex, more preferably between 2.4 and 3.0 dtex. As a result, the inventive viscose multifilament yarns are not only suited for the production of thin cords but also yield cords of a very high fatigue resistance. An example of this is high-tenacity inventive viscose multifilament yarn with a conditioned yarn linear density of 800 dtex with 300 filaments (rayon 800 dtex f300).

Apart from that, the type or construction of the cellulosic fibers is subject to no limitations. Thus, the inventive viscose multifilament yarn as such, or as chopped fibers, can be processed into a cord or a woven or knitted fabric, wherein the cord or the woven fabric can be used for reinforcement, e.g. of tires. Thus, for example, the inventive viscose multifilament yarn can be used for the production of a cord. The cord containing the inventive viscose multifilament yarn can be processed into a woven fabric. The woven fabric can be impregnated, and the impregnated woven fabric used for producing a tire. It is also possible to use the cord containing the inventive viscose multifilament yarn directly for producing a tire.

Further, the inventive multifilament yarn can serve as a reinforcement material for synthetic and natural elastomers or for other materials based on synthetic or renewable raw materials, for example for thermoplastic and thermosetting polymers. The listed materials—elastomers, thermoplastic or duromer materials—can include natural rubber, other poly(isoprene)s, poly(butadiene)s, polyisobutylenes, butyl rubber, poly(butadiene co-styrene)s, poly(butadiene co-acrylonitrile)s, polyethylene co-propylene)s, poly(isobutylene co-isoprene)s, poly(chloroprene)s, polyacrylates, polyamide, polyester, polylactide, polycarbonates, polyglucans, polyurethanes, polysulfides, silicones, polyvinyl chloride, poly(ether-ester), thermoplastic polyesters, cross-linked unsaturated polyesters, epoxy resins or blends of the above.

The invention claimed is:

1. Viscose multifilament yarn which has a crystallinity in the range from 24% to 30%, and, after conditioning in the standard climate according to DIN EN ISO 139:2005, a yarn linear density in the range from ≥150 dtex to <1100 dtex and a tensile strength in the range from ≥45 cN/tex to ≤55 cN/tex.

2. Viscose multifilament yarn according to claim 1, wherein the viscose multifilament yarn has a yarn linear density in the range from ≥200 dtex to <840 dtex, and a tensile strength in the range from ≥48 cN/tex to ≤53 cN/tex.

3. Viscose multifilament yarn according to claim 1, wherein the viscose multifilament yarn has a crystallite width in the range from 2.5 nm to 5 nm and a crystallite height in the range form 9 nm to 13 nm.

4. Viscose multifilament yarn according to claim 1, wherein the viscose multifilament yarn has a double refraction $\Delta n \cdot 10^4$ in the range from 300 to 450.

5. Viscose multifilament yarn according to claim 1, wherein the viscose multifilament yarn has a filament linear density in the range from 1.2 to 4.0 dtex.

6. Viscose multifilament yarn according to claim 5, wherein the viscose multifilament yarn has a filament linear density in the range from 2.4 to 3.0 dtex.

7. Viscose multifilament yarn according to claim 1, wherein the viscose multifilament yarn has an elongation at break in the range from ≥5% to ≤20%.

8. Viscose multifilament yarn according to claim 7, wherein the viscose multifilament yarn has an elongation at break in the range from ≥6% to ≤15%.

* * * * *